US012359339B2

(12) United States Patent
Tomita et al.

(10) Patent No.: US 12,359,339 B2
(45) **Date of Patent: *Jul. 15, 2025**

(54) PLATING APPARATUS AND SUBSTRATE HOLDER OPERATION METHOD

(71) Applicant: EBARA CORPORATION, Tokyo (JP)

(72) Inventors: Masaki Tomita, Tokyo (JP); Masaya Seki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 758 days.

This patent is subject to a terminal disclaimer.

(21) Appl. No.: 17/442,323

(22) PCT Filed: Dec. 9, 2020

(86) PCT No.: PCT/JP2020/045825

§ 371 (c)(1),
(2) Date: Sep. 23, 2021

(87) PCT Pub. No.: WO2022/123681

PCT Pub. Date: Jun. 16, 2022

(65) Prior Publication Data

US 2022/0364255 A1 Nov. 17, 2022

(51) Int. Cl.

| | |
|---|---|
| ***C25D 17/06*** | (2006.01) |
| ***C25D 7/12*** | (2006.01) |
| ***C25D 21/12*** | (2006.01) |

(52) U.S. Cl.

CPC ..... *C25D 17/06* (2013.01); *C25D 7/12* (2013.01); *C25D 21/12* (2013.01)

(58) Field of Classification Search

CPC ..... C25D 17/06–17/08; C25D 7/12–7/123
See application file for complete search history.

(56) References Cited

U.S. PATENT DOCUMENTS

| | | | | |
|---|---|---|---|---|
| 5,429,733 | A * | 7/1995 | Ishida | C25D 7/12 204/224 R |
| 2003/0201184 | A1* | 10/2003 | Dordi | C25D 21/00 257/E21.175 |
| 2019/0203373 | A1* | 7/2019 | Fujikata | H01L 21/68707 |

FOREIGN PATENT DOCUMENTS

| | | | |
|---|---|---|---|
| JP | 2003-501550 | A | 1/2003 |
| JP | 2014-051697 | A | 3/2014 |
| JP | 2018-003085 | A | 1/2018 |
| KR | 2013-0104695 | A | 9/2013 |
| WO | WO 2000/032848 | A2 | 6/2000 |

* cited by examiner

*Primary Examiner* — Alexander W Keeling
(74) *Attorney, Agent, or Firm* — BakerHostetler

(57) ABSTRACT

A plating module includes: a plating tank, a substrate holder, and an elevating mechanism. The plating tank is for housing a plating solution. The substrate holder is for holding a substrate with a surface to be plated facing downward. The elevating mechanism is for moving up and down the substrate holder. The substrate holder includes: a supporting mechanism, a floating plate, a floating mechanism, and a pushing mechanism. The supporting mechanism is for supporting an outer peripheral portion of the surface of the substrate. The floating plate is arranged on a back surface side of the substrate. The floating mechanism is for biasing the floating plate to a direction away from a back surface of the substrate. The pushing mechanism is for pressing the floating plate to the back surface of the substrate against a biasing force to the substrate by the floating mechanism.

16 Claims, 11 Drawing Sheets

1000

PLATING APPARATUS AND SUBSTRATE HOLDER OPERATION METHOD

TECHNICAL FIELD

This application relates to a plating apparatus and a substrate holder operation method.

BACKGROUND ART

There has been known a cup type electroplating apparatus as one example of a plating apparatus. The cup type electroplating apparatus immerses a substrate (for example, semiconductor wafer) held by a substrate holder with a surface to be plated facing downward in a plating solution, and applies a voltage between the substrate and an anode to deposit a conductive film on a surface of the substrate.

For example, PTL 1: discloses a substrate holder of an electroplating apparatus that includes a ring-shaped supporting member supporting an outer peripheral portion of a surface to be plated of a substrate and a ring-shaped diaphragm arranged on an outer peripheral portion of a back surface of the surface to be plated. This substrate holder is configured to press the substrate to the supporting member and seal between the substrate and the supporting member by supplying a fluid to the diaphragm to expand the diaphragm.

CITATION LIST

Patent Literature

PTL 1: Japanese Unexamined Patent Application Publication No, 2003-501550

SUMMARY OF INVENTION

Technical Problem

The substrate holder of the prior art has a room improvement in the point of enhancing the reliability of substrate holding.

That is, since the substrate holder of the prior art directly presses the back surface of the substrate with the diaphragm, there is a possibility that the diaphragm and the back surface of the substrate are rubbed, the diaphragm is damaged, and the substrate cannot be held. Further, if the ring-shaped diaphragm is locally rubbed with the substrate, a film thickness of the diaphragm possibly becomes non-uniform along a circumferential direction. Then, since a pressing force of the substrate becomes non-uniform along the circumferential direction, sealing performance between the substrate and the support member possibly be impaired.

Therefore, one object of this application is to ensure a substrate holder having high reliability of substrate holding.

Solution to Problem

According to one embodiment, a plating apparatus is disclosed. The plating apparatus includes: a plating tank, a substrate holder, and an elevating mechanism. The plating tank is for housing a plating solution: The substrate holder is for holding a substrate with a surface to be plated facing downward. The elevating mechanism is for moving up and down the substrate holder. The substrate holder includes: a supporting mechanism, a floating plate, a floating mechanism, and a pushing mechanism. The supporting mechanism is for supporting an outer peripheral portion of the surface to be plated of the substrate. The floating plate is arranged on a back surface side of the surface to be plated of the substrate. The floating, mechanism is for biasing the floating plate to a direction away from a back surface of the substrate. The pushing mechanism is for pressing the floating plate to the back surface of the substrate against a biasing force to the substrate by the floating mechanism.

DESCRIPTION OF EMBODIMENTS

Figure 1:
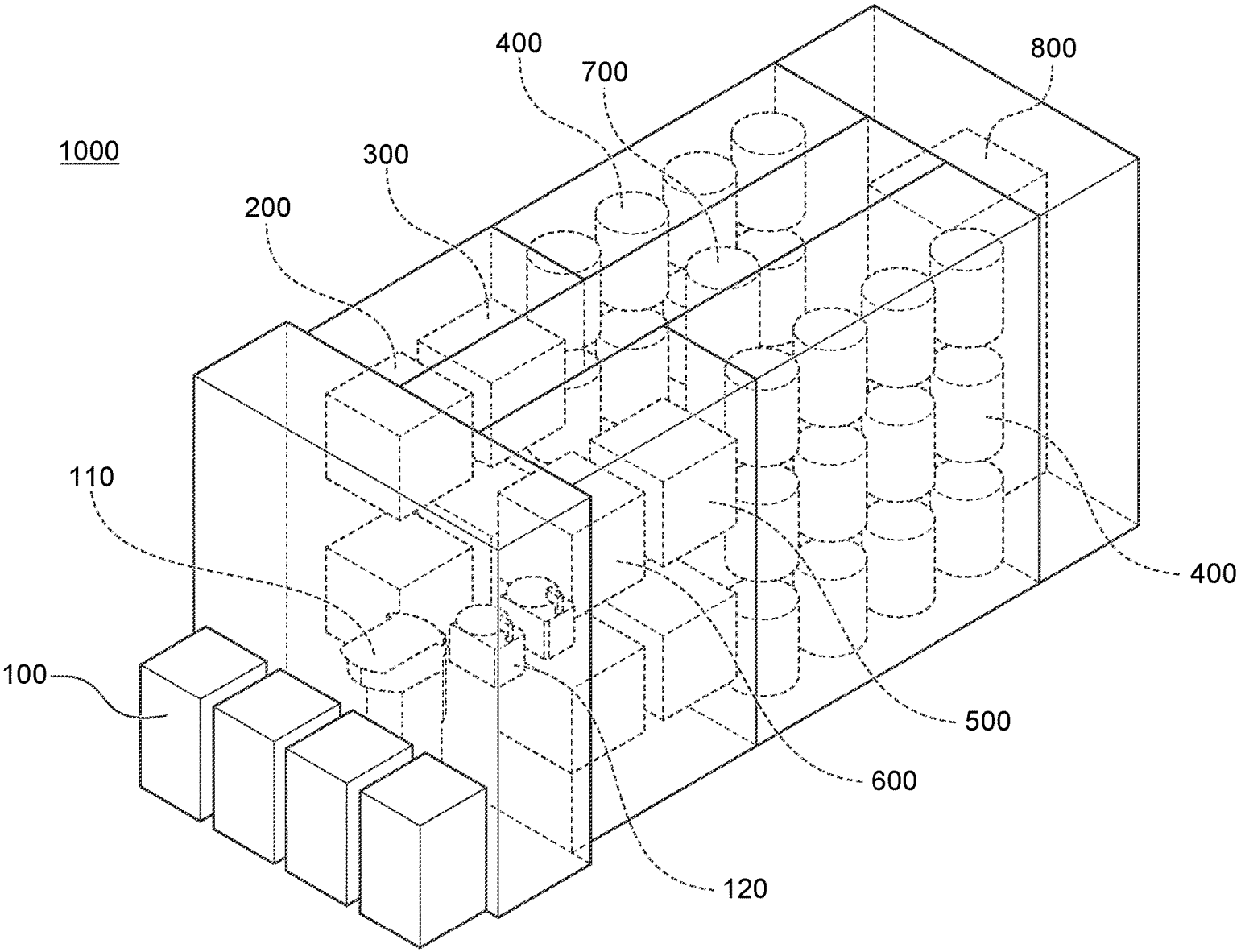
FIG. 1 is a perspective view illustrating an overall configuration of a plating apparatus of this embodiment.

The following will describe an embodiment of the present invention with reference to the drawings. In the drawings described later, the identical reference numerals are assigned for the identical or equivalent constituent elements, and therefore such elements will not be further elaborated here.

<Overall Configuration of Plating Apparatus>

Figure 2:
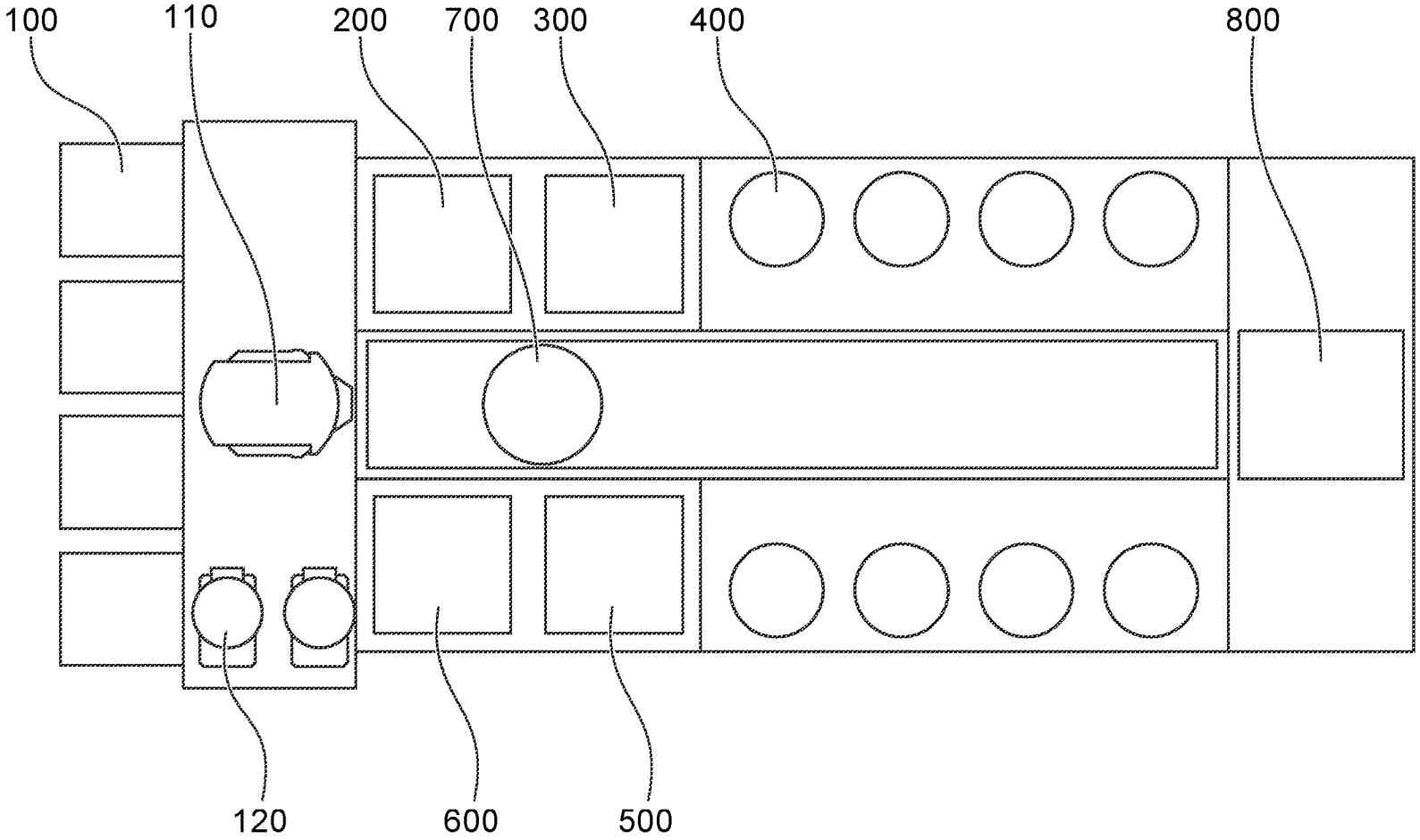
FIG. 2 is a plan view illustrating the overall configuration of the plating apparatus of this embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

<Configuration of Plating Module>

Figure 3:
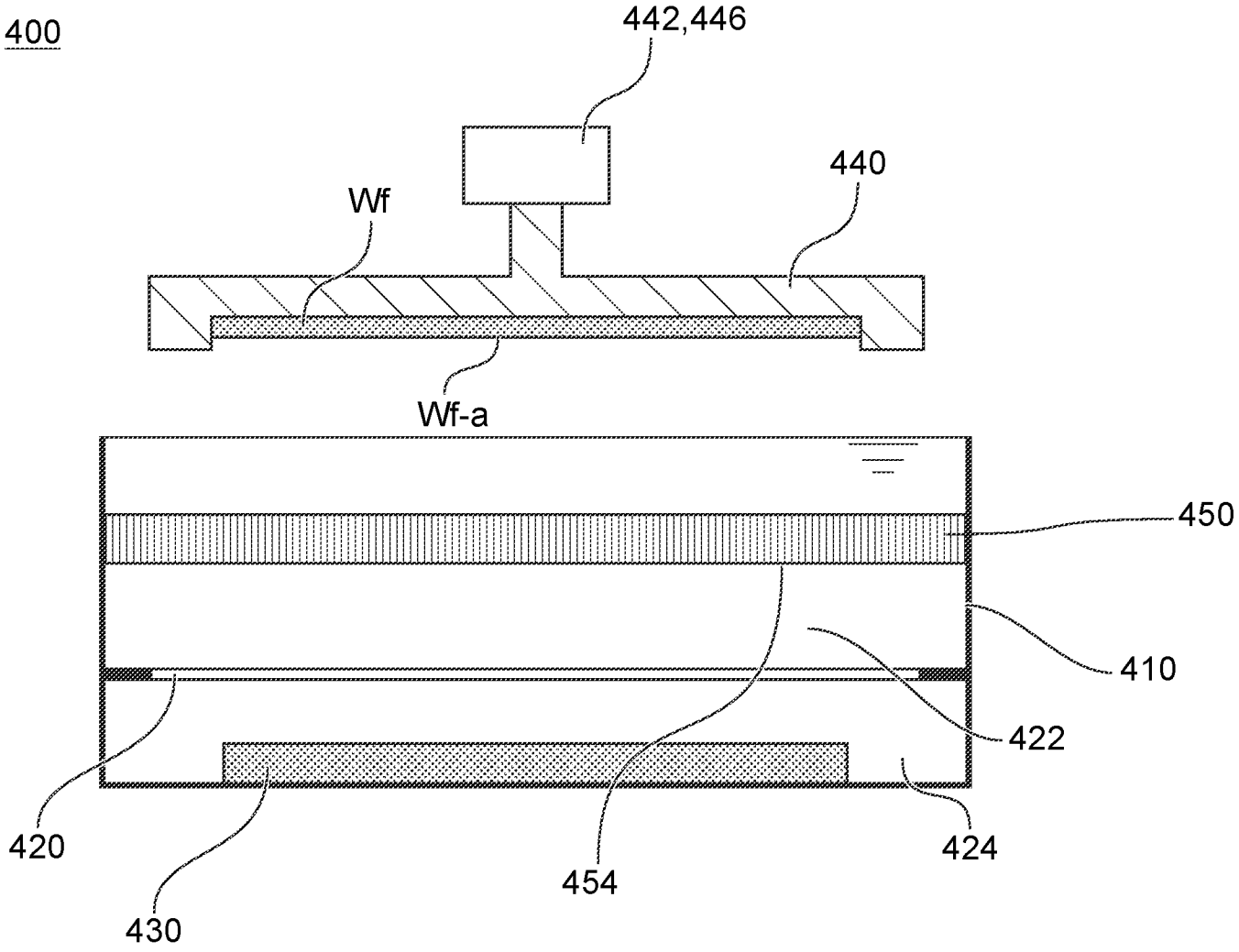
FIG. 3 is a vertical cross-sectional view schematically illustrating a configuration of a plating module of this embodiment.

Next, a configuration of the plating modules 400 will be described. Since the 24 plating modules 400 according to the embodiment have the identical configuration, only one plating module 400 will be described. FIG. 3 is a vertical cross-sectional view schematically illustrating the configuration of the plating module 400 of a first embodiment. As illustrated in FIG. 3, the plating module 400 includes a plating tank 410 for housing a plating solution. The plating module 400 includes a membrane 420 that separates an inside of the plating tank 410 in a vertical direction. The inside of the plating tank 410 is divided into a cathode region 422 and an anode region 424 by the membrane 420, The cathode region 422 and the anode region 424 are each filled with the plating solution. An anode 430 is disposed on a bottom surface of the plating tank 410 in the anode region 424. An ionically resistive element 450 opposed to the membrane 420 is arranged in the cathode region 422. The ionically resistive element 450 is a member for uniformizing the plating process on a surface to be plated Wf-a of a substrate Wf and configured by a plate-shaped member where many holes are formed.

Further, the plating module 400 includes a substrate holder 440 for holding the substrate Wf with the surface to be plated Wf-a facing downward. The substrate holder 440 includes a power feeding contact point (not illustrated) for feeding power from a power source to the substrate Wf. The plating module 400 includes an elevating mechanism 442 for moving up and down the substrate holder 440. The elevating mechanism 442 can be achieved by the known mechanism, such as a motor. The plating module 400 is configured to perform the plating process on the surface to be plated Wf-a of the substrate Wf by immersing the substrate Wf in the plating solution in the cathode region 422 using the elevating mechanism 442 and applying a voltage between the anode 430 and the substrate Wf.

Further, the plating module 400 includes a rotation mechanism 446 for rotating the substrate holder 440 such that the substrate Wf rotates about a virtual rotation axis extending perpendicularly in a center of the surface to be plated Wf-a. The rotation mechanism 446 can be achieved by the known mechanism, such as a motor.

<Configuration of Substrate Holder>

Figure 4:
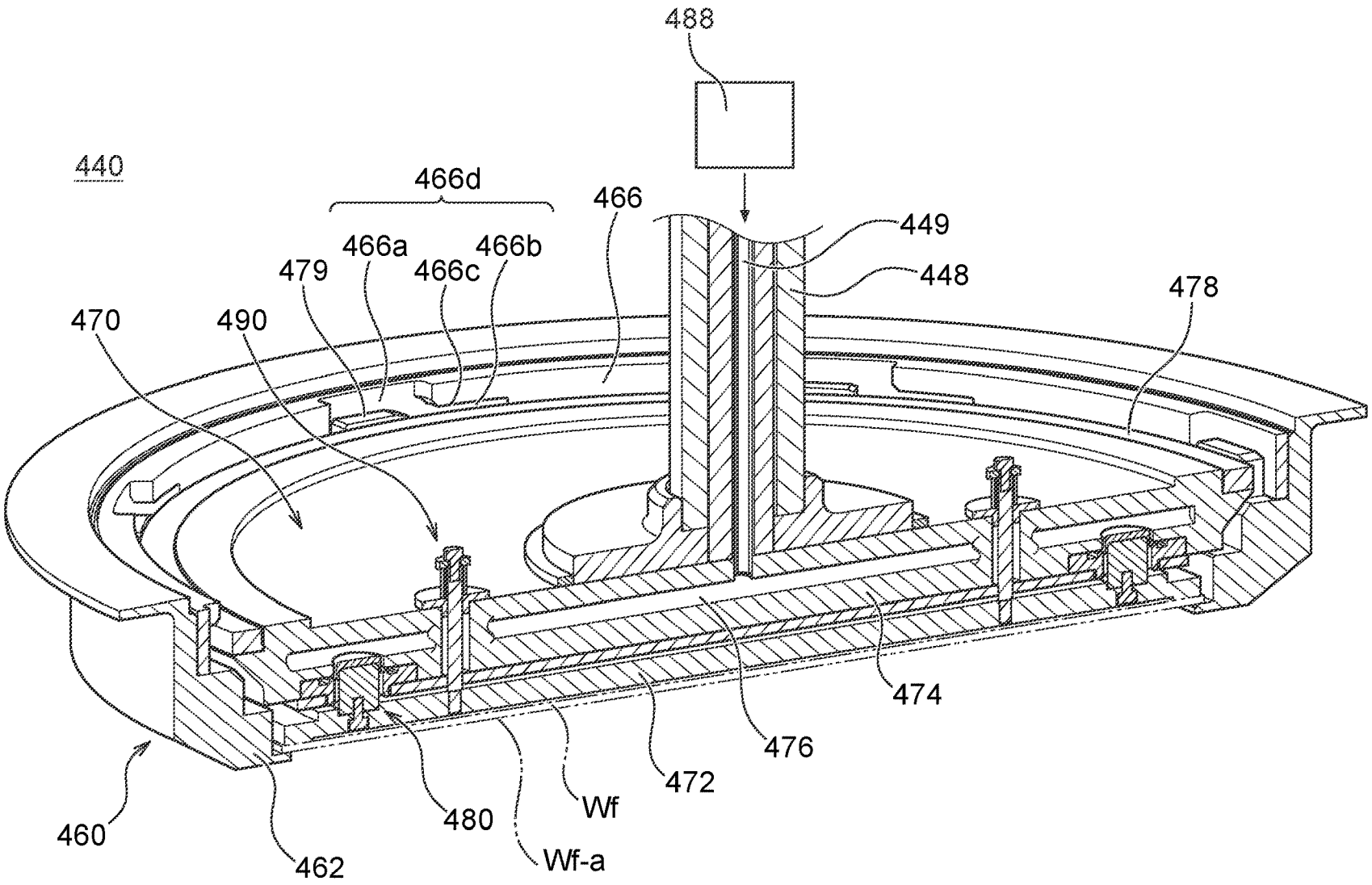
FIG. 4 is a perspective view schematically illustrating a configuration of a substrate holder of this embodiment.
Figure 5:
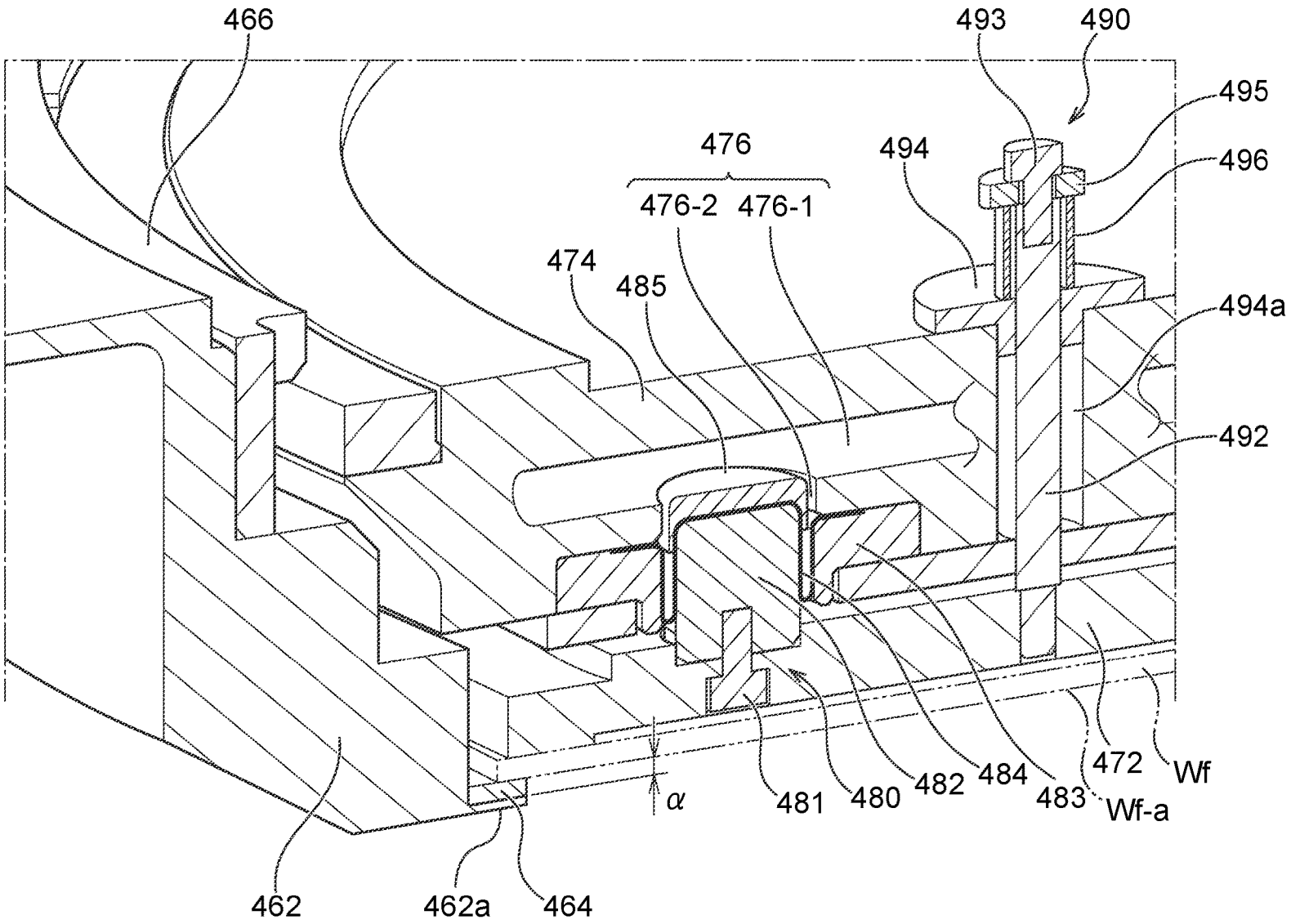
FIG. 5 is an enlarged perspective view schematically illustrating a part of the substrate holder of this embodiment.

Next, the detail of the substrate holder 440 of this embodiment will be described. FIG. 4 is a perspective view schematically illustrating a configuration of the substrate holder of this embodiment. FIG. 5 is an enlarged perspective view schematically illustrating a part of the substrate holder of this embodiment.

As illustrated in FIG. 4 and FIG. 5, the substrate holder 440 includes a supporting mechanism 460 for supporting an outer peripheral portion of the surface to be plated Wf-a of the substrate Wf, a back plate assembly 470 for holding the substrate Wf, and a rotation shaft 448 extending vertically upward from the back plate assembly 470.

The back plate assembly 470 includes a circular plate-shaped floating plate 472 for sandwiching the substrate Wf with the supporting mechanism 460. The floating plate 472 is arranged on the back surface side of the surface to be plated Wf-a of the substrate Wf. Further, the back plate assembly 470 includes floating mechanisms 490 and a pushing mechanism 480. The floating mechanisms 490 are for biasing the floating plate 472 to a direction away from the back surface of the substrate Wf. The pushing mechanism 480 is for pressing the floating plate 472 to the back surface of the substrate Wf against a biasing force to the substrate Wf by the floating mechanisms 490.

The pushing mechanism 480 includes a circular plate-shaped back plate 474 arranged on an upper side of the floating plate 472 and a flow passage 476 formed inside the back plate 474. The flow passage 476 includes a first flow passage 476-1 and second flow passages 476-2, The first flow passage 476-1 extends radially from a center portion of the back plate 474 toward the outer peripheral portion. The second flow passages 476-2 extend in the vertical direction so as to open from the first flow passage 476-1 to a lower surface of the back plate 474, The pushing mechanism 480 includes diaphragms 484 arranged in the second flow passages 476-2. The diaphragm 484 is a thin film-shaped member. The diaphragm 484 has an outer peripheral portion secured to the lower surface of the back plate 474 by a securing member 483. The pushing mechanism 480 includes rods 482, as an aspect of pressing members, arranged between the diaphragms 484 and the floating plate 472, The rod 482 has a lower surface secured to the floating plate 472 by a bolt 481, and the rod 482 has an upper surface in contact with a lower surface of the diaphragm 484. The rod 482 has an upper portion covered with a cap 485 sandwiching the diaphragm 484. The diaphragm 484 has a center portion sandwiched by the cap 485 and the rod 482. A plurality of the diaphragms 484, the rods 482, and the caps 485 are disposed along the circumferential direction of the back plate assembly 470. Note that while this embodiment has shown the example in which the rods 482 as different members from the floating plate 472 are secured to the upper surface of the floating plate 472, it is not limited thereto. For example, projections may be formed on the upper surface of the floating plate 472 along the circumferential direction. In this case, the projections have a function as the pressing member similar to the rod 482.

The pushing mechanism 480 includes a fluid source 488 for supplying a fluid to the diaphragms 484. The fluid may be a gas, such as air, or may be a liquid, such as water, in the rotation shaft 448, a flow passage 449 extending along the gravity direction is formed, and the fluid source 488 is connected to an upper end of the flow passage 449. The flow passage 449 has a lower end connected to the first flow passage 476-1 formed in the back plate 474. The first flow passage 476-1 extends radially from the center of the back plate 474 and communicates with upper surfaces of the caps 485 via the second flow passages 476-2. The fluid source 488 supplies the fluid to the diaphragms 484 via the flow passage 449 and the flow passage 476. Then, the caps 485 and the rods 482 are pressed downward, whereby the floating plate 472 is pressed downward.

The supporting mechanism 460 includes a circular supporting member 462 for supporting the outer peripheral portion of the surface to be plated Wf-a of the substrate Wf. The supporting member 462 has a flange 462*a* protruding to an outer peripheral portion of a lower surface of the back plate assembly 470. A circular sealing member 464 is arranged on the flange 462*a*. The sealing member 464 is a member having elasticity. The supporting member 462 supports the outer peripheral portion of the surface to be plated Wf-a of the substrate Wf via the sealing member 464. Sandwiching the substrate Wf between the sealing member 464 and the floating plate 472 seals between the supporting member 462 and the substrate Wf Since the sealing member 464 has elasticity, the sealing member 464 is crushed in accordance with the pressing force of the substrate Wf by the pushing mechanism 480 to vary a thickness $\alpha$.

The supporting mechanism 460 includes a circular clamper 466 held by the supporting member 462. The clamper 466 can move up and down the back plate assembly 470 with respect to the supporting mechanism 460 when the substrate Wf is installed to/extracted from the substrate holder 440. Further, the clamper 466 can restrict the back plate 474 from moving to an upward direction (direction away from the back surface of the substrate Wf) when the fluid is supplied from the fluid source 488 to the diaphragm 484. This point will be described below.

The back plate assembly 470 includes a slide ring 478 circularly disposed on the outer peripheral portion of an upper surface of the back plate 474. The slide ring 478 is movable in the circumferential direction independently of the back plate 474. The back plate assembly 470 includes slide plates 479 projecting from the slide ring 478 toward the clamper 466.

On the other hand, hook-like cutouts 466*d* are formed on a surface opposed to the slide ring 478 in the clamper 466. The hook-like cutout 466*d* has a first groove 466*a* and a second groove 466*h*. The first groove 466*a* extends in the vertical direction such that the slide plate 479 can be moved up and down. The second groove 466*b* communicates with the first groove 466*a* and extends along the circumferential direction of the clamper 466. The second groove 466*b* has an upper surface on which an abutting surface 466*c* is formed. The abutting surface 466*c* abuts on an upper surface of the slide plate 479 moving in accordance with a movement in the upward direction of the back plate 474 when the fluid is supplied from the fluid source 488 to the diaphragms 484. A plurality of the slide plates 479 and the cutouts 466*d* are disposed along the circumferential direction of the substrate holder 440.

When the substrate Wf is installed with respect to the substrate holder 440, the back plate assembly 470 is positioned on an upper side with respect to the supporting mechanism 460. When the substrate Wf is placed with respect to the supporting mechanism 460 in this state, the back plate assembly 470 can be moved down with respect to the supporting mechanism 460 by adjusting a position in the circumferential direction of the slide plates 479 to the first grooves 466*a*. After the back plate assembly 470 is moved down, the slide plates 479 are fit in the second grooves 466*b* by rotating the slide ring 478 in the circumferential direction. Since this causes the slide plates 479 and the abutting surfaces 466*c* to oppose, a movement in the upward direction of the back plate assembly 470 is restricted.

The floating mechanism 490 includes a shaft 492 extending from the floating plate 472 to the upper side via a through-hole 494*a* of the back plate 474. The shaft 492 has a lower end secured to the floating plate 472. The floating mechanism 490 includes a flange 495 mounted on an upper portion of the shaft 492 with respect to the back plate 474. The flange 495 is mounted on an upper end of the shaft 492 by a bolt 493. The floating mechanism 490 includes a guide 494 disposed in the through-hole 494*a*. The guide 494 has a hole slightly larger than an outer diameter of the shaft 492 and is mounted on an upper end of the through-hole 494*a*. The guide 494 is configured to guide a movement in an elevating direction of the shaft 492. By providing the guide 494, generation of misalignment in a radial direction of the floating plate 472 and the back plate 474 can be suppressed.

The floating mechanism 490 includes a compression spring 496 mounted on an upper surface of the guide 494 and a lower surface of the flange 495. The compression spring 496 may be disposed between the upper surface of the back plate 474 and the lower surface of the flange 495. Since the compression spring 496 has a biasing force that lifts the flange 495 upward, the floating plate 472 is biased to the direction away from the back surface of the substrate Wf via the shaft 492.

Figure 6:
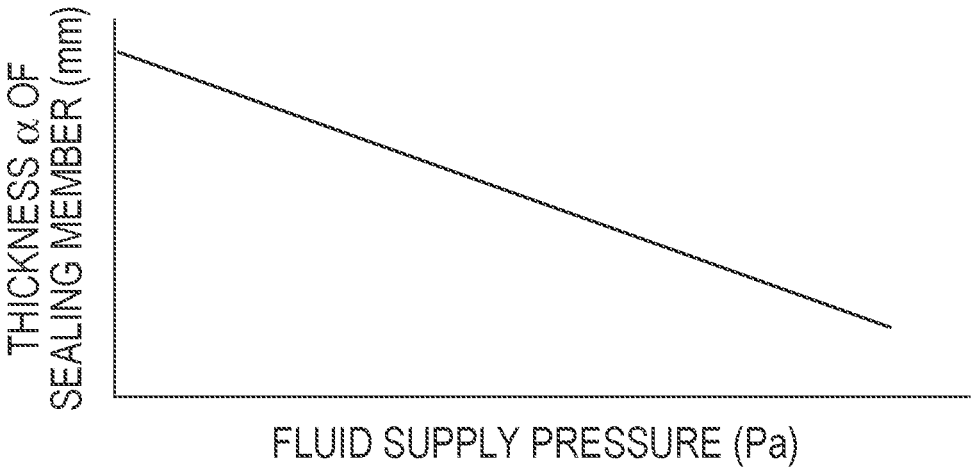
FIG. 6 is a graph showing a relation between a fluid supply pressure by a pushing mechanism of the substrate holder and a thickness of a sealing member.

When the fluid is supplied from the fluid source 488, the pushing mechanism 480 presses the substrate Wf to the sealing member 464 with a force stronger than the biasing force to the substrate Wf by the floating mechanisms 490. The pushing mechanism 480 can vary a holding position of the substrate Wf depending on a pressure of the fluid supplied from the fluid source 488. FIG. 6 is a graph showing a relationship between a fluid supply pressure by a pushing mechanism of the substrate holder and a thickness of a sealing member. In FIG. 6, the horizontal axis is a pressure (Pa) of the fluid supplied from the fluid source 488, and the vertical axis is the thickness $\alpha$ (mm) of the sealing member 464.

As the pressure of the fluid supplied from the fluid source 488 increases, a crushing amount of the sealing member 464 increases. Therefore, as shown in FIG. 6, the thickness of the sealing member 464 becomes thin in proportion to the increase in the pressure of the fluid supplied from the fluid source 488. The thickness of the sealing member 464 becoming thin means that the holding position of the substrate Wf moves downward, which means that a distance between the anode 430 and the substrate Wf becomes short. That is, by adjusting a flow rate of the fluid supplied from the fluid source 488, the distance between the anode 430 and the substrate Wf can be adjusted. Accordingly, with this embodiment, by adjusting the distance between the anode 430 and the substrate Wf depending on a type of the substrate Wf, uniformity of a plating film-thickness on the surface to be plated Wf-a can be improved.

With the substrate holder 440 of this embodiment, instead of pressing the diaphragms 484 directly to the substrate Wf, the substrate Wf is pressed by the floating plate 472. Therefore, a possibility of breakage of the diaphragms 484 by a friction with the substrate Wf can be reduced. Further, with the substrate holder 440 of this embodiment, since the outer peripheral portion of the substrate Wf is pressed by the floating plate 472, the substrate Wf can be pressed stably. As a result, sealing performance between the substrate Wf and the supporting member 462 can be improved and reliability of a substrate holding can be improved.

Figure 7:
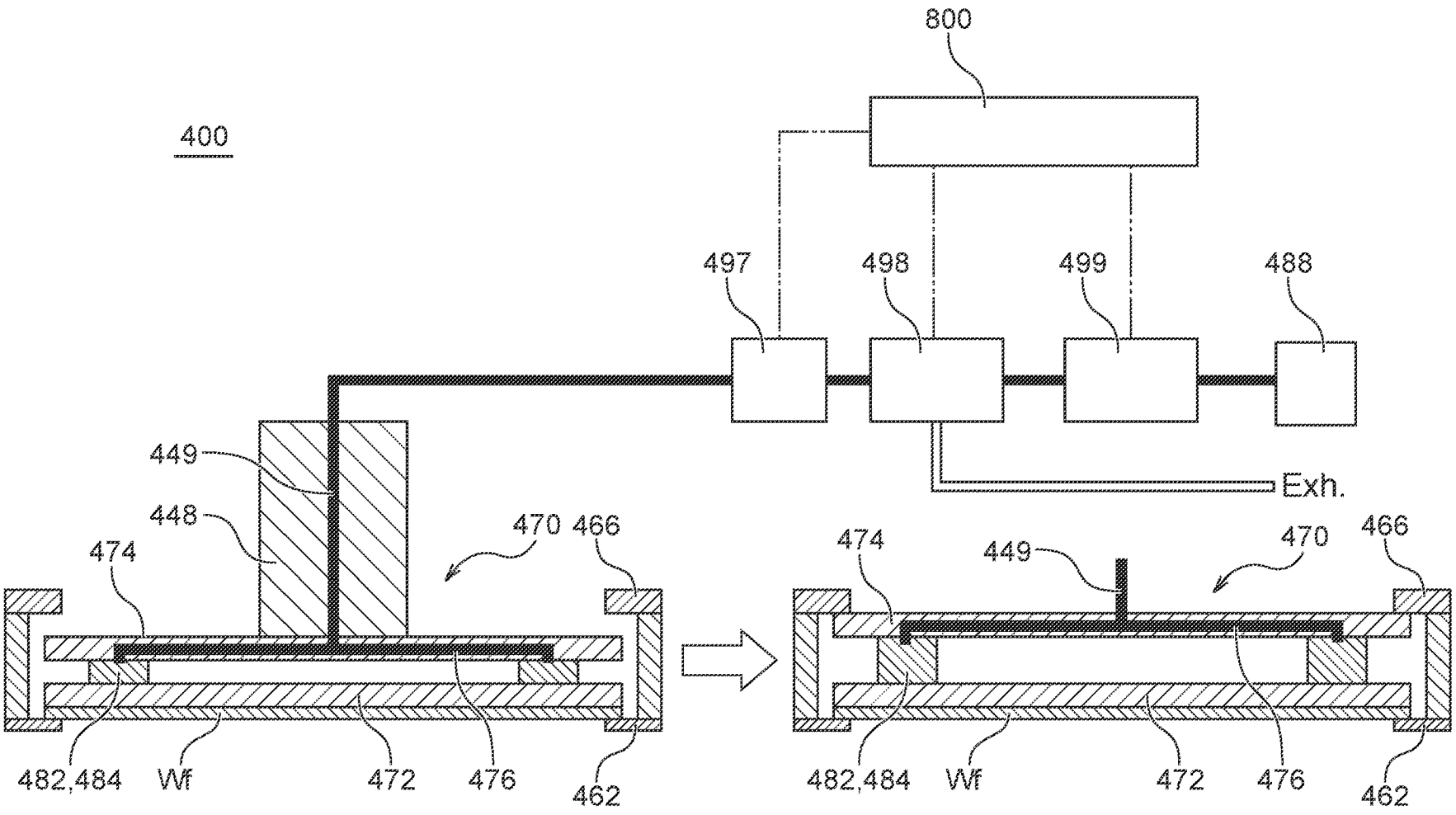
FIG. 7 is a view schematically illustrating a substrate holding operation in the substrate holder of this embodiment.
Figure 8:
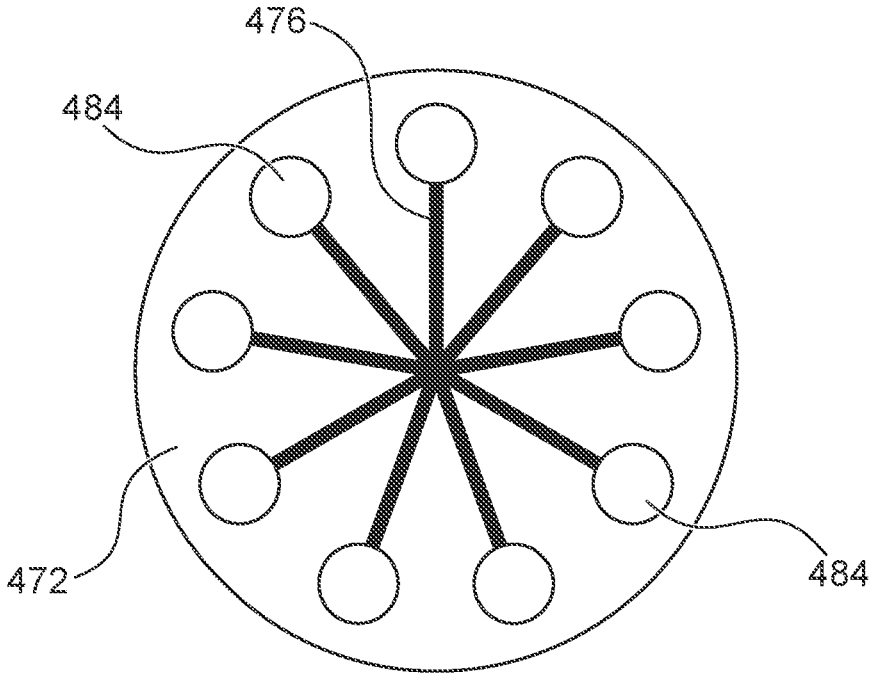
FIG. 8 is a plan view schematically illustrating an arrangement aspect of the pushing mechanism of the substrate holder.

Next, a substrate holding operation of the substrate holder 440 of this embodiment will be described. FIG. 7 is a view schematically illustrating a substrate holding operation in the substrate holder of this embodiment. FIG. 8 is a plan view schematically illustrating an arrangement aspect of a pushing mechanism of the substrate holder.

As illustrated in FIG. 7, the plating module 400 includes a pressure sensor 497 and the control module (control member) 800. The pressure sensor 497 is for measuring the pressure of the fluid supplied to the diaphragms 484. The control module 800 is for detecting a failure in pressing of the floating plate 472 based on the measured pressure by the pressure sensor 497. The control module 800 also has a function to adjust the flow rate of the fluid supplied from the fluid source 488 to the diaphragms 484. Further, the plating module 400 includes an electropneumatic regulator 499 and a valve 498. The electropneumatic regulator 499 is for adjusting the flow rate of the fluid supplied from the fluid source 488 corresponding to a signal output from the control module 800. The valve 498 is for exhausting the fluid in the flow passage 449 corresponding to a signal output from the control module 800.

As illustrated in FIG. 7, when the back plate assembly 470 moves down to a position where the back plate assembly 470 is surrounded by the supporting mechanism 460, the fluid is supplied from the fluid source 488 to the diaphragms 484 via the electropneumatic regulator 499. As illustrated in FIG. 8, a plurality of the diaphragms 484 are disposed along the circumferential direction of the floating plate 472. Therefore, when the fluid is supplied to the diaphragms 484, the diaphragms 484 press the entire floating plate 472 to the substrate Wf side. When the outer peripheral portion of the surface to be plated Wf-a of the substrate Wf abuts on the sealing member 464, the back plate 474 is pressed upward by its reactive force. In association with this, the slide ring 478 and the slide plates 479 also move upward. Then, since the slide plates 479 are fit in the second grooves 466*b* as described above, the slide plates 479 abut on the abutting surfaces 466*c*. When the fluid is further supplied to the diaphragms 484 from this state, the floating plate 472 presses the substrate Wf while crushing the sealing member 464. This allows the substrate Wf to be sandwiched between the floating plate 472 and the supporting member 462, and sealing between the substrate Wf and the supporting member 462.

The control module 800 monitors a pressure value measured by the pressure sensor 497 while the floating plate 472 is applying pressure to the substrate Wf. The control module 800 can detect a failure in pressing of the floating plate 472 based on the pressure value measured by the pressure sensor 497. For example, if the pressure value does not rise even though the fluid is supplied from the fluid source 488 to the diaphragms 484, or when the pressure value rapidly decreases after rising, there is a possibility that the substrate Wf cannot be pressed because some sort of abnormality, such as leakage of the fluid, happens. The control module 800 can urge a user to check by outputting an alarm when a failure in pressing of the floating plate 472 is detected.

Figure 9:
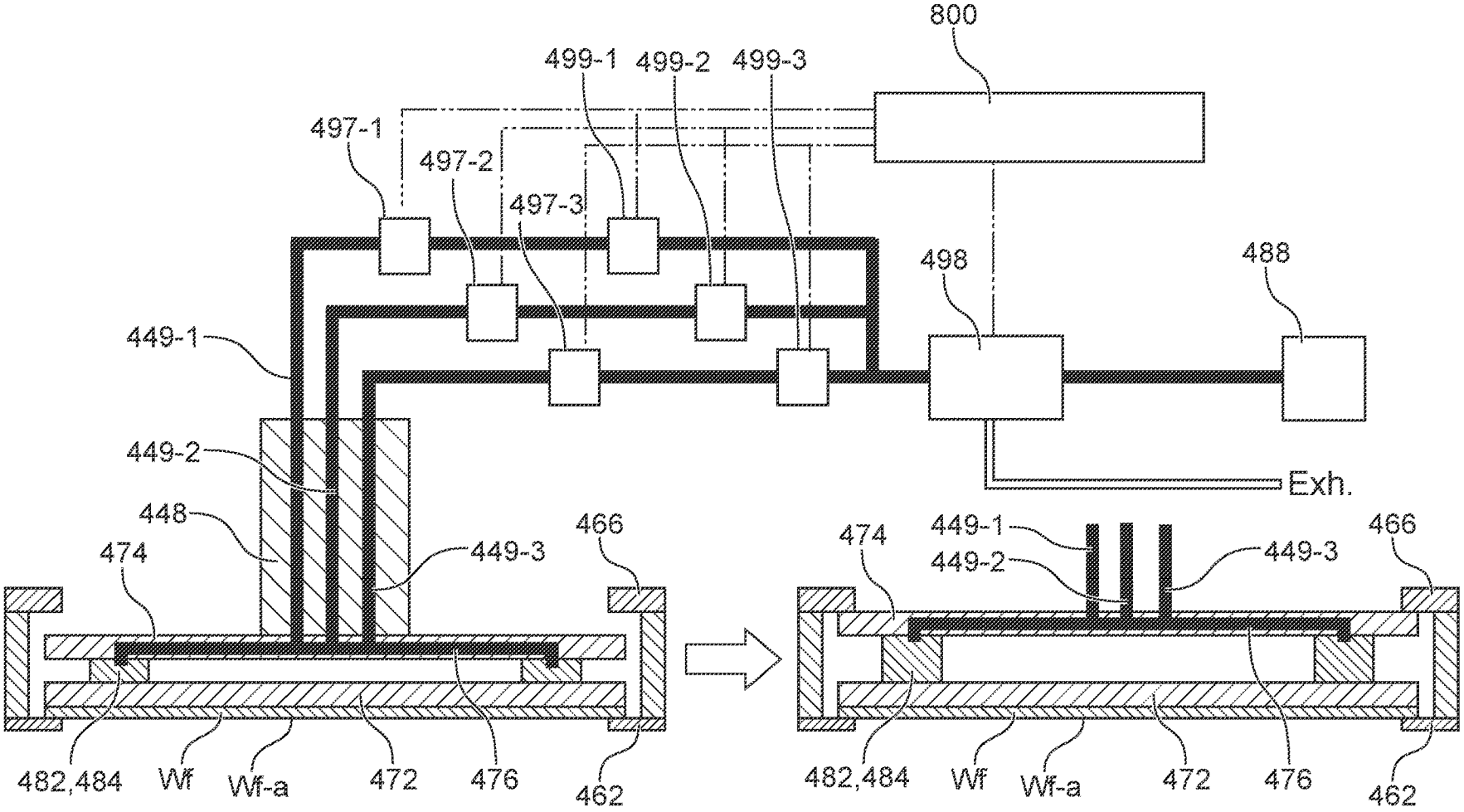
FIG. 9 is a view schematically illustrating a substrate holding operation in the substrate holder of this embodiment.
Figure 10:
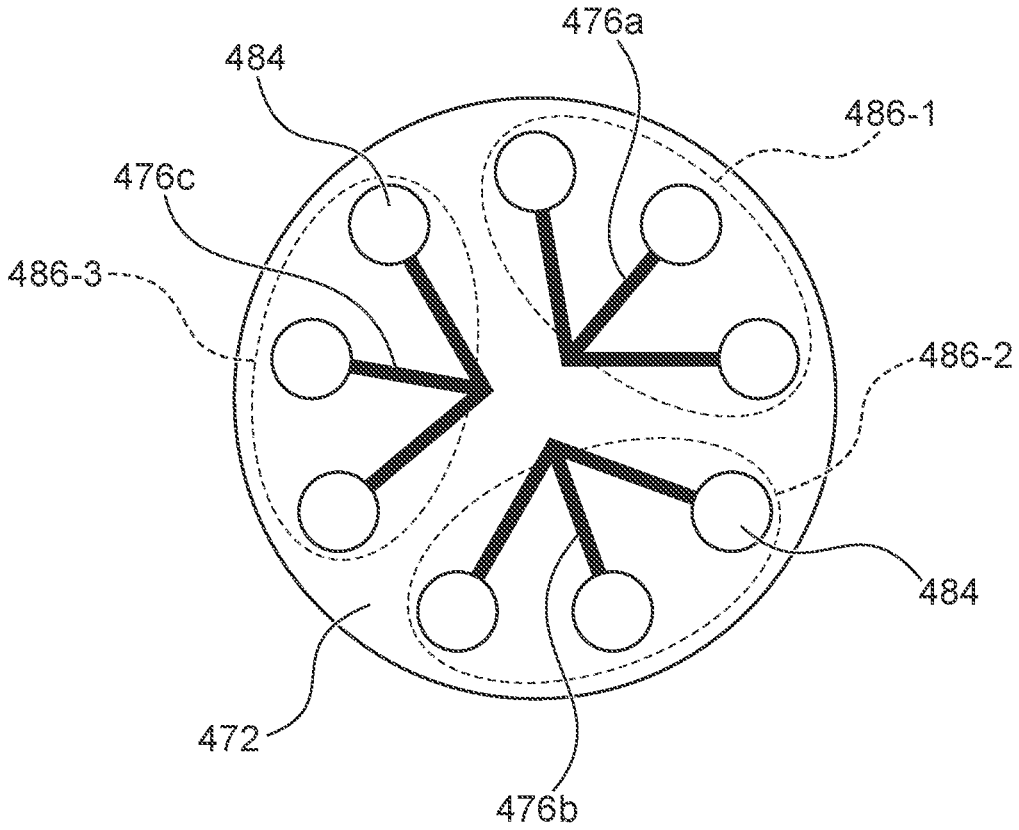
FIG. 10 is a plan view schematically illustrating an arrangement aspect of the pushing mechanism of the substrate holder.

FIG. 9 is a view schematically illustrating a substrate holding operation in the substrate holder of this embodiment. FIG. 10 is a plan view schematically illustrating an arrangement aspect of a pushing mechanism of the substrate holder.

As illustrated in FIG. 9 and FIG. 10, the fluid source 488 can supply the fluid individually to each of groups, a plurality (nine pieces) of the diaphragms 484 are grouped into a plurality (three pieces) of the groups. Specifically, a first flow passage group 476*a* formed in the back plate 474 is connected to the three pieces of diaphragms 484 included in a first group 486-1, a second flow passage group 476*b* is connected to the three pieces of diaphragms 484 included in a second group 486-2, and a third flow passage group 476*c* is connected to the three pieces of diaphragms 484 included in a third group 486-3. The first flow passage group 476*a* is connected to a first flow passage 449-1 extending along the gravity direction in the rotation shaft 448, the second flow passage group 476*b* is connected to a second flow passage 449-2 extending along the gravity direction in the rotation shaft 448, and the third flow passage group 476*c* is connected to a third flow passage 449-3 extending along the gravity direction in the rotation shaft 448.

On the first flow passage 449-1, a first pressure sensor 497-1 and a first electropneumatic regulator 499-1 are disposed. On the second flow passage 449-2, a second pressure sensor 497-2 and a second electropneumatic regulator 499-2 are disposed. On the third flow passage 449-3, a third pressure sensor 497-3 and a third electropneumatic regulator 499-3 are disposed. The control module 800 is configured to individually control the first electropneumatic regulator 499-1, the second electropneumatic regulator 499-2, and the third electropneumatic regulator 499-3. This allows the control module 800 to individually adjust the flow rate of the fluid supplied from the fluid source 488 to each of the first group 486-1, the second group 486-2, and the third group 486-3.

With this embodiment, since the flow rate of the fluid supplied to each of the first group 486-1, the second group 486-2, and the third group 486-3 can be individually adjusted, the pressing force of the substrate Wf against the supporting member 462 can be adjusted along the circumferential direction. For example, assume that, when the plating process is performed with the anode 430 parallel to the surface to be plated Wf-a of the substrate Wf, the plating film-thickness of a specific region of the substrate Wf tends to be thinner than the other region and the plating film-thickness of the entire substrate Wf tends to be non-uniform. In this case, for the substrate Wf having such a tendency, as long as the specific region is pressed against the supporting member 462 stronger than the other region, the specific region can be made closer to the anode 430 than the other region. As a result, non-uniformity of the plating film-thickness between the specific region of the substrate Wf and the other region is corrected, and the uniformity of the plating film-thickness of the entire substrate Wf can be improved.

Further, with this embodiment, the control module 800 can identify a location where a failure in pressing of the floating plate 472 occurs based on the pressure values measured by the first pressure sensor 497-1, the second pressure sensor 497-2, and the third pressure sensor 497-3. For example, assume the case where only the pressure value of the first group 486-1 does not rise regardless of supplying the fluid equally to each of the first group 486-1, the second group 486-2, and the third group 486-3, or the case where only the pressure value of the first group 486-1 rapidly decreases after rising. In this case, there is a possibility that some sort of abnormality, such as leakage of the fluid, happens in the system of the first group 486-1 and the substrate Wf cannot be pressed. The control module 800 can urge a user to check by outputting an alarm identifying the location where a failure in pressing possibly happens (system of the first group 486-1) when the failure in pressing of the floating plate 472 is detected.

Figure 11:
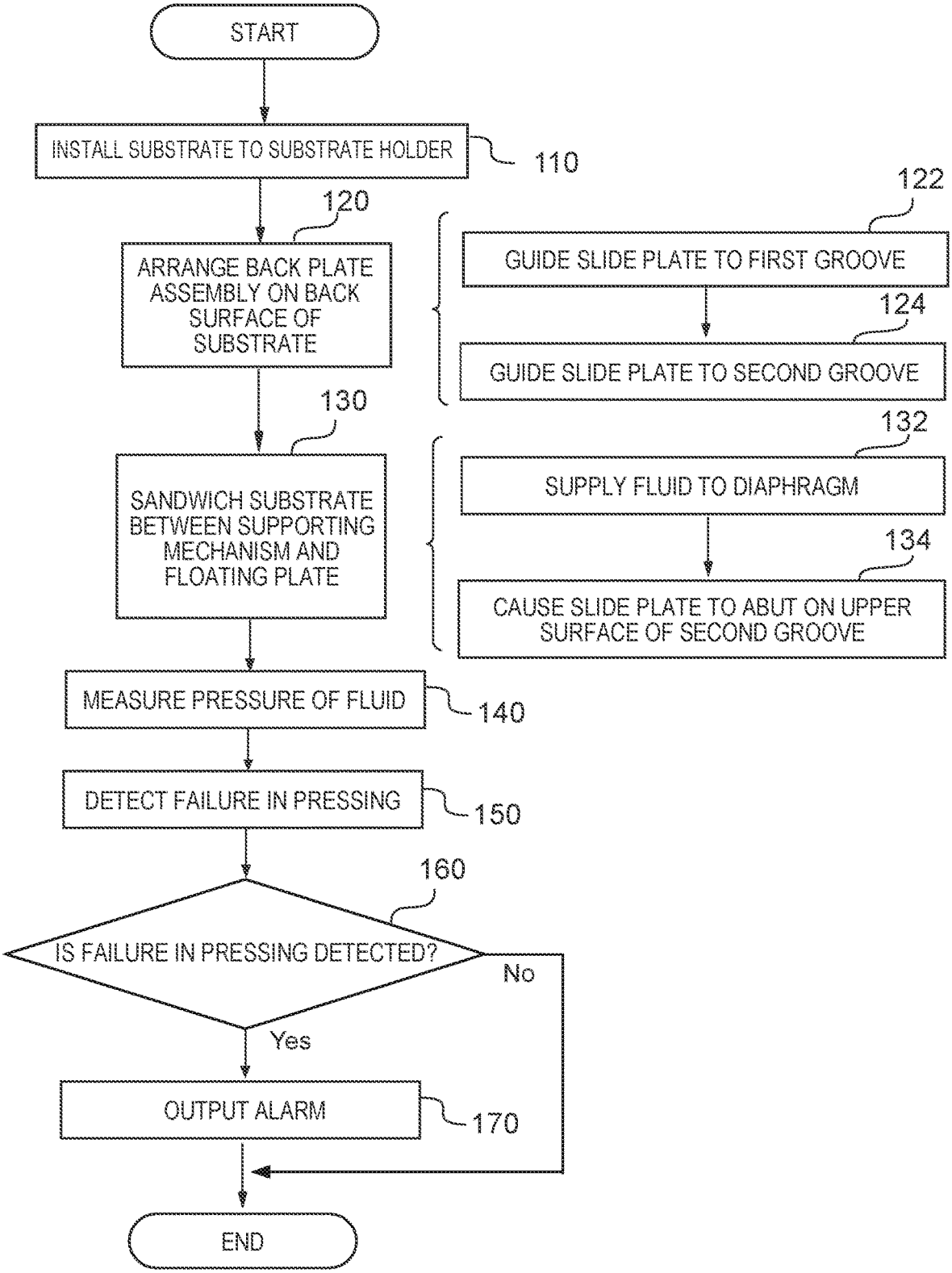
FIG. 11 is a flowchart for describing a substrate holder operation method of this embodiment.

Next, an operation method of the substrate holder 440 of this embodiment will be described. FIG. 11 is a flowchart for describing a substrate holder operation method of this embodiment. The following describes the substrate holder operation method in which the plurality of diaphragms 484 disposed along the circumferential direction of the floating plate 472 are divided into the first group 486-1, the second group 486-2, and the third group 486-3 as illustrated in FIG. 9 and FIG. 10.

As illustrated in FIG. 11, in the substrate holder operation method, first, the substrate Wf with the surface to be plated Wf-a facing downward is installed to the supporting member 462 of the substrate holder 440 (installing step 110), Next, in the substrate holder operation method, the back plate assembly 470 including the floating plate 472 is moved down and arranged on the back surface side of the surface to be plated Wf-a of the substrate Wf (arranging step 120).

Specifically, in the arranging step 120, the position of the slide plates 479 is adjusted to the position of the first grooves 466*a*, and while the slide plates 479 are guided to the first grooves 466*a*, the back plate assembly 470 is moved dour (first guiding step 122). Next, in the arranging step 120, by rotating the slide ring 478, the slide plates 479 are guided to the second grooves 466*b* (second guiding step 124).

After the arranging step 120, in the substrate holder operation method, the floating plate 472 in a state of being biased to the upper side by the floating mechanisms 490 is pressed downward against the biasing force by the floating mechanisms 490 to sandwich the substrate Wf between the supporting mechanism 460 and the floating plate 472 (sandwiching step 130).

Specifically, in the sandwiching step 130, the fluid is supplied to the diaphragms 484 via the flow passage 476 (supplying step 132). In the supplying step 132, the fluid is individually supplied to each of the groups 486-1, 486-2, and 486-3. Next, in the sandwiching step 130, the back plate 474 and the slide ring 478 are moved up by the supplying step 132 to cause the slide plates 479 to abut on the upper surfaces (abutting surfaces 466*c*) of the second grooves 466*b* (abutting step 134).

Note that, in the above-described supplying step 132, the flow rate of the fluid supplied to each of the groups 486-1, 486-2, and 486-3 can be adjusted using the first, second, and third electropneumatic regulators 499-1, 499-2, and 499-3. This allows for adjusting the pressing force (in other words, crushing amount of the sealing member 464) of the substrate Wf against the supporting member 462, thereby being able to adjust the distance between the anode 430 and the surface to be plated Wf-a. In the supplying step 132, the fluid may be equally supplied to each of the groups 486-1, 486-2, and 486-3, or the fluid can be unequally supplied. For example, assume that the plating film-thickness of the substrate Wf specific region tends to be thicker than other region, and the plating film-thickness of the entire substrate Wf tends to be non-uniform. In this case, for the substrate Wf having such a tendency, the fluid flow rate of the groups corresponding to the specific region can be reduced more than the fluid flow rate of the groups corresponding to the other region. Since this allows for pressing the specific region of the substrate Wf to the supporting member 462 more weakly than the other region, the specific region can be separated from the anode 430 more than the other region. As a result, non-uniformity of the plating film-thickness between the specific region of the substrate Wf and the other region is corrected, and the uniformity of the plating film-thickness of the entire substrate Wf can be improved.

After the sandwiching step 130, in the substrate holder operation method, a pressure of the fluid supplied to the diaphragms 484 by the supplying step 132 is measured (measuring step 140). In the measuring step 140, the pressure of the fluid supplied to each of the groups 486-1, 486-2, and 486-3 can be individually measured using the first, second, and third pressure sensors 497-1, 497-2, and 497-3.

In the substrate holder operation method, a failure in pressing of the floating plate 472 is detected based on the pressure measured by the measuring step 140 (detecting step 150). In the substrate holder operation method, whether or not a failure in pressing of the floating plate 472 is detected by the detecting step 150 is determined (determining step 160). In the substrate holder operation method, when the determining step 160 determines that a failure in pressing of the floating plate 472 is detected (determining step 160, Yes), an alarm is output to a user (step 170). On the other hand, in the substrate holder operation method, when the determining step 160 determines that a failure in pressing of the floating plate 472 is not detected (determining step 160, No), or after the step 170, the process of the substrate holder operation method ends.

Although several embodiments of the present invention have been explained above, these embodiments of the invention described above are for the purpose of facilitating the understanding of the present invention, and are not intended to limit the present invention. The present invention may be modified or improved without departing from the gist of the invention, and the present invention obviously includes equivalents thereof. Further, the constituent elements described in the scope of the claims and the specification may be arbitrarily combined or eliminated within a scope in which the above-described problems can be at least partially solved or a scope in which the effects can be at least partially achieved.

As one embodiment, this application discloses a plating apparatus that includes a plating tank, a substrate holder, and an elevating mechanism. The plating tank is for housing a plating solution. The substrate holder is for holding a substrate with a surface to be plated facing downward. The elevating mechanism is for moving up and down the substrate holder. The substrate holder includes a supporting mechanism, a floating plate, a floating mechanism, and a pushing mechanism. The supporting mechanism is for supporting an outer peripheral portion of the surface to be plated of the substrate. The floating plate is arranged on a back surface side of the surface to be plated of the substrate. The floating mechanism is for biasing the floating plate to a direction away from a back surface of the substrate. The pushing mechanism is for pressing the floating plate to the back surface of the substrate against a biasing force to the substrate by the floating mechanism.

Furthermore, as one embodiment, this application discloses a plating apparatus in which the pushing mechanism includes a back plate, a flow passage, a diaphragm, a pressing member, and a fluid source. The back plate is arranged on an upper side of the floating plate. The flow passage is formed inside the back plate so as to open to a lower surface of the back plate. The diaphragm is arranged in the flow passage. The pressing member is arranged between the diaphragm and the floating plate. The fluid source is for supplying a fluid to the diaphragm via the flow passage.

Furthermore, as one embodiment, this application discloses a plating apparatus in which the supporting mechanism includes a circular supporting member for supporting an outer peripheral portion of the surface to be plated of the substrate via a sealing member, and a circular clamper held by the supporting member, clamper having an abutting surface for restricting the back plate from moving to an upward direction when a fluid is supplied from the fluid source to the diaphragm.

Furthermore, as one embodiment, this application discloses a plating apparatus in which the substrate holder has a slide ring circularly disposed on an outer peripheral portion of the back plate, the slide ring being movable in a circumferential direction independently of the back plate, and a slide plate projecting from the slide ring toward the clamper, the clamper has, on a surface opposed to the slide ring, a hook-like cutout having a first groove extending in a vertical direction such that the slide plate is allowed to move up and down, and a second groove communicating with the first groove and extending along a circumferential direction of the clamper, and the abutting surface is formed on an upper surface of the second groove.

Furthermore, as one embodiment, this application discloses a plating apparatus in which the floating mechanism includes a shaft extending from the floating plate to an upper side via a through-hole of the back plate, a flange mounted on an upper portion of the shaft with respect to the back plate, and a compression spring mounted on an upper surface of the back plate and the flange.

Furthermore, as one embodiment, this application discloses a plating apparatus in which the floating mechanism further includes a guide disposed in the through-hole for guiding a movement in an elevating direction of the shaft.

Furthermore, as one embodiment, this application discloses a plating apparatus in which a plurality of the diaphragms and the rods are disposed along a circumferential direction of the floating plate, the fluid source is configured to be able to individually supply a fluid to each of the plurality of the diaphragms or each of groups, the plurality of diaphragms are grouped into a plurality of the groups, the plating apparatus further comprises a control member for individually adjusting a flow rate of a fluid supplied from the fluid source to each of the plurality of diaphragms or each of the groups.

Furthermore, as one embodiment, this application discloses a plating apparatus that further includes a pressure sensor and a control member. The pressure sensor is for measuring a pressure of a fluid supplied to the diaphragm. The control member is for detecting a failure in pressing of the floating plate based on a measured pressure by the pressure sensor.

Furthermore, as one embodiment, this application discloses a plating apparatus that further includes a plurality of the diaphragms and the rods are disposed along a circumferential direction of the floating plate. The fluid source is configured to be able to individually supply a fluid to each of the plurality of diaphragms or each of groups, the plurality of diaphragms being grouped into a plurality of the groups, and the pressure sensor is configured to measure a pressure of a fluid supplied to each of plurality of the diaphragms or each of the groups.

Furthermore, as one embodiment, this application discloses a substrate holder operation method that includes: an installing step of installing a substrate with a surface to be plated facing downward to a supporting member of a substrate holder of a plating apparatus; an arranging step of moving down and arranging a back plate assembly including a floating plate on a back surface side of the surface to be plated of the substrate; and a sandwiching step of pressing downward the floating plate in a state of being biased to an upper side by a floating mechanism against a biasing force by the floating mechanism to sandwich the substrate between the supporting mechanism and the floating plate.

Furthermore, as one embodiment, this application discloses a substrate holder operation method in which the sandwiching step includes a supplying step of supplying a fluid to a diaphragm and a pressing member that are arranged in a flow passage via a flow passage formed in a back plate arranged on an upper side of the floating plate.

Furthermore, as one embodiment, this application discloses a substrate holder operation method in which the arranging step includes a first guiding step of guiding a slide plate projecting outward from a slide ring disposed on an outer peripheral portion of the back plate to a first groove formed along a vertical direction in a circular clamper arranged on an upper side of the supporting member, and a second guiding step of guiding the slide plate to a second groove communicating with the first groove and formed along a circumferential direction of the clamper by rotating the slide ring.

Furthermore, as one embodiment, this application discloses a substrate holder operation method in which the sandwiching step includes an abutting step of moving up the back plate and the slide ring by the supplying step to cause the slide plate to abut on an upper surface of the second groove.

Furthermore, as one embodiment, this application discloses a substrate holder operation method that further includes: a measuring step of measuring a pressure of a fluid supplied to the diaphragm by the supplying step; and a detecting step of detecting a failure in pressing of the floating plate based on a pressure measured by the measuring step.

Furthermore, as one embodiment, this application discloses a substrate holder operation method in which the supplying step includes an individual supplying step of individually supplying a fluid to each of a plurality of diaphragms arranged along a circumferential direction of the floating plate or each of groups, the plurality of diaphragms being grouped into a plurality of the groups.

Furthermore, as one embodiment, this application discloses a substrate holder operation method in which the supplying step includes an individual supplying step of individually supplying a fluid to each of a plurality of diaphragms arranged along a circumferential direction of the floating plate or each of groups, the plurality of diaphragms being grouped into a plurality of the groups, and the measuring step includes an individual measuring step of individually measuring a pressure of a fluid supplied to each of the plurality of diaphragms or the respective groups by the individual supplying step.

REFERENCE SIGNS LIST

400 . . . plating module
410 . . . plating tank
430 . . . anode
440 . . . substrate holder
442 . . . elevating mechanism
446 . . . rotation mechanism
448 . . . rotation shaft
449 . . . flow passage
460 . . . supporting mechanism
462 . . . supporting member
462*a* . . . flange
464 . . . sealing member
466 . . . clamper
466*a* . . . first groove
466*b* . . . second groove
466*c* . . . abutting surface
466*d* . . . cutout
470 . . . back plate assembly
472 . . . floating plate
474 . . . back plate
476 . . . flow passage
478 . . . slide ring
479 . . . slide plate
480 . . . pushing mechanism
482 . . . rod
484 . . . diaphragm
488 . . . fluid source
490 . . . floating mechanism
492 . . . shaft
494 . . . guide
494*a* . . . through-hole
496 . . . compression spring
497 . . . pressure sensor
800 . . . control module (control member)
1000 . . . plating apparatus
Wf . . . substrate
Wf-a . . . surface to be plated

The invention claimed is:

1. A plating apparatus comprising:
a plating tank for housing a plating solution;
a substrate holder configured to hold a substrate with a surface to be plated facing downward; and
an elevating mechanism for moving up and down the substrate holder; wherein
the substrate holder includes:
a supporting mechanism for supporting an outer peripheral portion of the surface to be plated of the substrate;
a floating plate arranged on a back surface side of the surface to be plated of the substrate;
a floating mechanism for biasing the floating plate to a direction away from a back surface of the substrate; and
a pushing mechanism for pressing the floating plate to the back surface of the substrate against a biasing force to the substrate by the floating mechanism.

2. The plating apparatus according to claim 1, wherein
the pushing mechanism includes:
a back plate arranged on an upper side of the floating plate;
a flow passage formed inside the back plate so as to open to a lower surface of the back plate;
a diaphragm arranged in the flow passage;
a pressing member arranged between the diaphragm and the floating plate; and
a fluid source for supplying a fluid to the diaphragm via the flow passage.

3. The plating apparatus according to claim 2, wherein
the supporting mechanism includes a circular supporting member for supporting an outer peripheral portion of the surface to be plated of the substrate via a sealing member, and a circular clamper held by the supporting member, the clamper having an abutting surface for restricting the back plate from moving to an upward direction when a fluid is supplied from the fluid source to the diaphragm.

4. The plating apparatus according to claim 3, wherein
the substrate holder has a slide ring circularly disposed on an outer peripheral portion of the back plate, the slide ring being movable in a circumferential direction independently of the back plate, and a slide plate projecting from the slide ring toward the clamper, the clamper has, on a surface opposed to the slide ring, a hook-like cutout having a first groove extending in a vertical direction such that the slide plate is allowed to move up and down, and a second groove communicating with the first groove and extending along a circumferential direction of the clamper, and the abutting surface is formed on an upper surface of the second groove.

5. The plating apparatus according to claim 2, wherein the floating mechanism includes a shaft extending from the floating plate to an upper side via a through-hole of the back plate, a flange mounted on an upper portion of the shaft with respect to the back plate, and a compression spring mounted on an upper surface of the back plate and the flange.

6. The plating apparatus according to claim 5, wherein the floating mechanism further includes a guide disposed in the through-hole for guiding a movement in an elevating direction of the shaft.

7. The plating apparatus according to claim 2, wherein a plurality of the diaphragms and the pressing members are disposed along a circumferential direction of the floating plate, the fluid source is configured to be able to individually supply a fluid to each of the plurality of the diaphragms or each of groups, the plurality of diaphragms are grouped into a plurality of the groups, and the plating apparatus further comprises a control member for individually adjusting a flow rate of a fluid supplied from the fluid source to each of the plurality of diaphragms or each of the groups.

8. The plating apparatus according to claim 2, further comprising:

a pressure sensor for measuring a pressure of a fluid supplied to the diaphragm; and a control member for detecting a failure in pressing of the floating plate based on a measured pressure by the pressure sensor.

9. The plating apparatus according to claim 8, wherein a plurality of the diaphragms and the pressing members are disposed along a circumferential direction of the floating plate, the fluid source is configured to be able to individually supply a fluid to each of the plurality of diaphragms or each of groups, the plurality of diaphragms being grouped into a plurality of the groups, and the pressure sensor is configured to measure a pressure of a fluid supplied to each of plurality of the diaphragms or each of the groups.

10. A substrate holder operation method comprising:

an installing step of installing a substrate with a surface to be plated facing downward to a supporting member of a substrate holder of a plating apparatus;

an arranging step of moving down and arranging a back plate assembly including a floating plate on a back surface side of the surface to be plated of the substrate; and a sandwiching step of pressing downward the floating plate in a state of being biased to an upper side by a floating mechanism against a biasing force by the floating mechanism to sandwich the substrate between the supporting mechanism and the floating plate.

11. The substrate holder operation method according to claim 10, wherein the sandwiching step includes a supplying step of supplying a fluid to a diaphragm and a pressing member that are arranged in a flow passage via a flow passage formed in a back plate arranged on an upper side of the floating plate.

12. The substrate holder operation method according to claim 10, wherein the arranging step includes a first guiding step of guiding a slide plate projecting outward from a slide ring disposed on an outer peripheral portion of the back plate to a first groove formed along a vertical direction in a circular clamper arranged on an upper side of the supporting member, and a second guiding step of guiding the slide plate to a second groove communicating with the first groove and formed along a circumferential direction of the clamper by rotating the slide ring.

13. The substrate holder operation method according to claim 12, wherein the sandwiching step includes an abutting step of moving up the back plate and the slide ring by the supplying step to cause the slide plate to abut on an upper surface of the second groove.

14. The substrate holder operation method according to claim 11, further comprising:

a measuring step of measuring a pressure of a fluid supplied to the diaphragm by the supplying step; and a detecting step of detecting a failure in pressing of the floating plate based on a pressure measured by the measuring step.

15. The substrate holder operation method according to claim 11, wherein the supplying step includes an individual supplying step of individually supplying a fluid to each of a plurality of diaphragms arranged along a circumferential direction of the floating plate or each of groups, the plurality of diaphragms being grouped into a plurality of the groups.

16. The substrate holder operation method according to claim 11, wherein the supplying step includes an individual supplying step of individually supplying a fluid to each of a plurality of diaphragms arranged along a circumferential direction of the floating plate or each of groups, the plurality of diaphragms being grouped into a plurality of the groups, and the measuring step includes an individual measuring step of individually measuring a pressure of a fluid supplied to each of the plurality of diaphragms or the respective groups by the individual supplying step.

* * * * *